US007000983B1

(12) United States Patent
Tsai

(10) Patent No.: US 7,000,983 B1
(45) Date of Patent: Feb. 21, 2006

(54) FOLDING LOUNGE CHAIR

(76) Inventor: Yao-Hsien Tsai, Xiuxin Road Xiuzhou Industrial Garden Jiaxing, Zhejiang (CN)

( * ) Notice: Subject to any disclaimer, the term of this patent is extended or adjusted under 35 U.S.C. 154(b) by 0 days.

(21) Appl. No.: 10/908,092

(22) Filed: Apr. 27, 2005

(51) Int. Cl.
*A47C 4/00* (2006.01)

(52) U.S. Cl. ..... 297/56

(58) Field of Classification Search ..... 297/56, 297/55, 49, 48, 46, 29, 24, 16.1, 378.1
See application file for complete search history.

(56) References Cited

U.S. PATENT DOCUMENTS

| | | | | | |
|---|---|---|---|---|---|
| 102,178 | A | * | 4/1870 | Stewart | 297/56 |
| 414,801 | A | * | 11/1889 | Edwards et al. | 297/29 |
| 1,838,213 | A | * | 12/1931 | Buffington | 297/55 |
| 2,530,785 | A | * | 11/1950 | Rocca | 297/156 |
| 2,646,141 | A | * | 8/1953 | Marshall et al. | 108/120 |
| 2,652,882 | A | * | 9/1953 | Kotler | 297/29 |
| 3,649,074 | A | * | 3/1972 | McDonald et al. | 297/153 |
| 6,332,646 | B1 | | 12/2001 | Tseng | |
| 6,447,057 | B1 | | 9/2002 | Chen | |
| 2004/0251718 | A1 | * | 12/2004 | Degen et al. | 297/55 |

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

A folding lounge chair has a seat frame, including a front leg and a rear leg crossing each other and hinged to the seat frame. At the crossing of the front leg and the rear leg, a hinge plate having a guide groove is fixed to the rear leg. At two ends of the guide groove are, respectively, upper and lower arrest units. The lower arrest unit is curved upwards. At one end of the lower arrest unit is provided a projected retaining part. One end of a bolt is fixed onto the rear leg, the other end running through the guide groove of the hinge plate, permitting the bolt to glide up and down along the guide groove. Besides allowing the lounge chair to retain a simplified construction, when the legs are unfolded, the bolt will not glide into the lower arrest unit and will be arrested by the projected retaining part. Therefore, the legs will not easily fold up. By lightly patting on the rear leg, the bolt will jump away from the projected retaining part and escape out of the lower arrest unit, and allow the legs to be folded up. Thereby, the legs of the chair can be easily folded or unfolded by simple operation.

3 Claims, 5 Drawing Sheets

FOLDING LOUNGE CHAIR

BACKGROUND OF THE INVENTION

1. Field of the Invention

The present invention relates to a folding lounge chair, with a hinge joining the front and rear legs after they are unfolded, so that the chair is secured after they are unfolded, and the chair will not fold up even when the chair is lifted or moved to another location, providing an easy and simplified structure and operation.

2. Description of the Prior Art

Folding lounge chairs are well known in the prior art. Key features are that they are comfortable to sit in for long periods of time and their ease of folding and compactness for portability. However, conventional folding lounge chairs demonstrate shortcomings, which significantly hinder their more widespread acceptance and use.

For example, the chairs designed by Tseng in U.S. Pat. No. 6,332,646B1 are examples of folding lounge chairs, including three V-shaped legs hinged onto a ring frame. At the crossing of the two V-shaped legs at the front are respectively provided with matching rings. On the rear of the V-shaped legs, a rod with an extended end is inserted into the aforementioned two rings is provided. At the other end of the rod, a flexible wire is provided, and one end of the wire is hooked onto the ring. Also, the chairs designed by Chen in U.S. Pat. No. 6,447,057 are examples of folding lounge chairs, wherein a seat frame is hinged with two crossing and hinged front legs and rear legs. The ends of the front legs are hinged to a seat frame using an extension rod. When the front and rear legs are unfolded, the extension rod will extend to a specified length and be secured in position. Therefore, the above two inventions, though of different structures, permit the chair to be secured when it is unfolded, without the risk of being loosened and folded up when it is unfolded. However, those structures do involve sophistication and inconvenience in their securing operation when the chair is unfolded, or in the process of folding the chair.

SUMMARY OF THE INVENTION

Therefore, to maintain the simple structure of the lounge chair while having easier operation either in folding or unfolding the chair, the present invention includes front and rear legs crossing each other and hinged onto a seat frame. At the crossing of the front and rear legs, a hinge plate with a guide groove is fixed on the rear leg. At the two ends of the guide groove are, respectively, upper and lower arrest units, with the lower arrest unit being curved upwards. A bolt fixed onto the rear leg is provided in the guide groove, permitting the bolt to glide up and down inside the guide groove.

Where the lower arrest part curved upwards, a projected retaining part is provided at a lower part of the guide groove on the hinge plate to arrest the bolt gliding inside the guide groove.

Therefore, with the structure of the present invention, and when the front and rear legs of the lounge chair are unfolded, the bolt will glide down into the lower arrest unit and be arrested by the projected retaining part. Thus, the two legs of the chair will not be easily folded up, thereby increasing the stability of the chair in use.

Furthermore, when intending to fold up the two legs of the chair, the user need only pat lightly on the rear leg, and the bolt will escape the projected retaining part and out of the lower arrest unit, so that the legs can be folded up.

BRIEF DESCRIPTION OF DRAWINGS

Other features and advantages of the present invention will become apparent in the following detailed description of the preferred embodiment with reference to the accompanying drawings, of which.

DESCRIPTION OF THE PREFERRED EMBODIMENT

Figure 1:
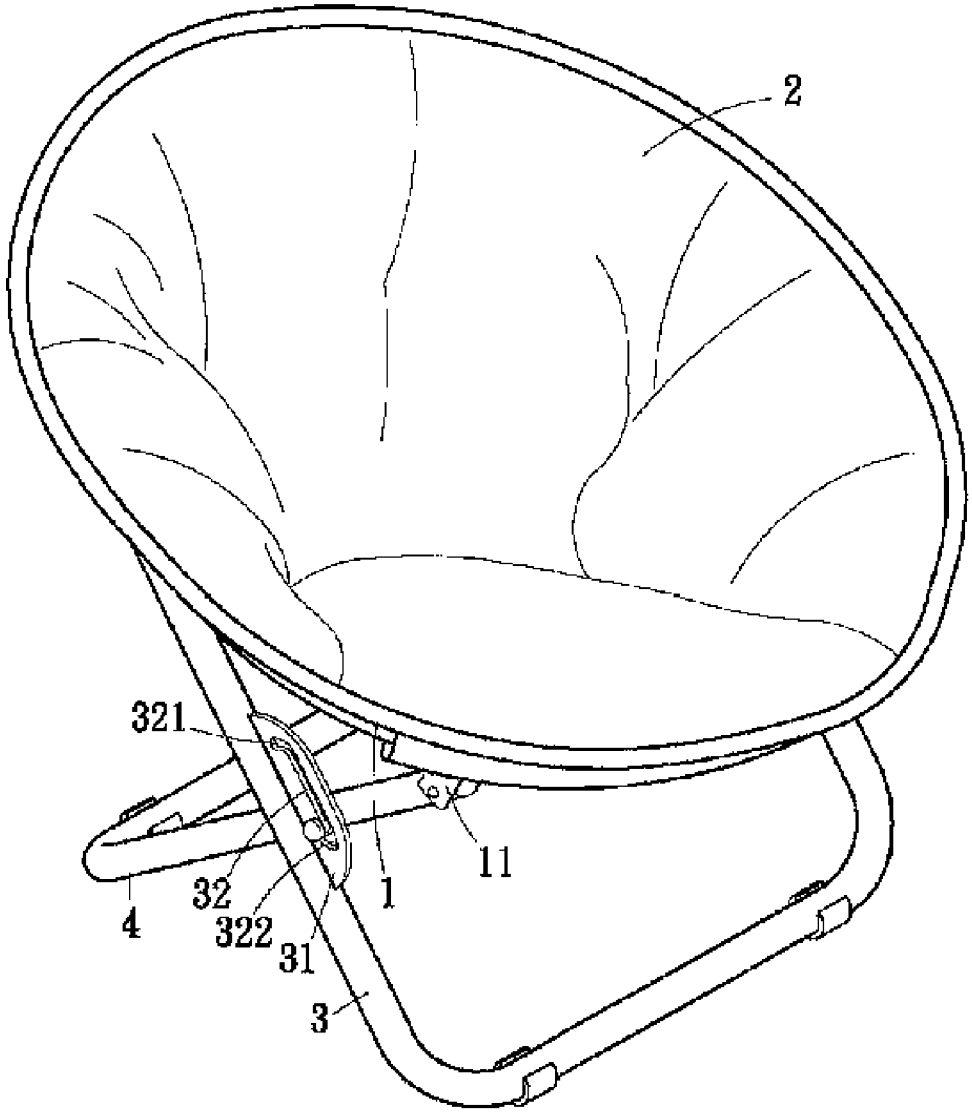
FIG. 1 is a perspective view of the present invention.
Figure 2:
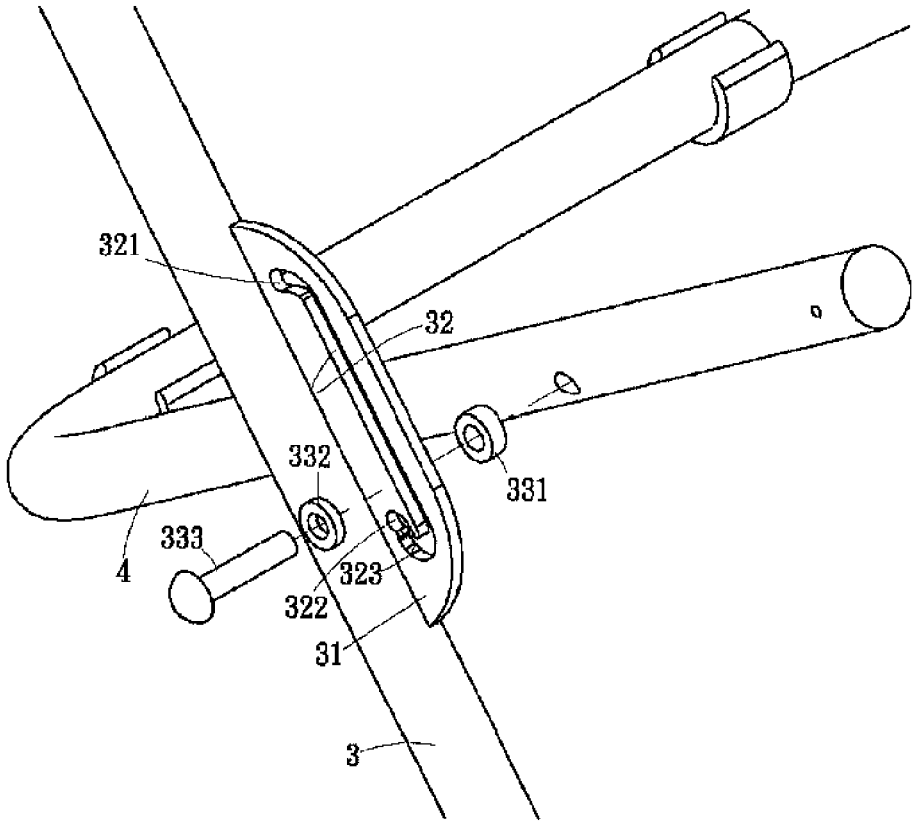
FIG. 2 is a partial, exploded view showing the joint of the front and rear legs.
Figure 3:
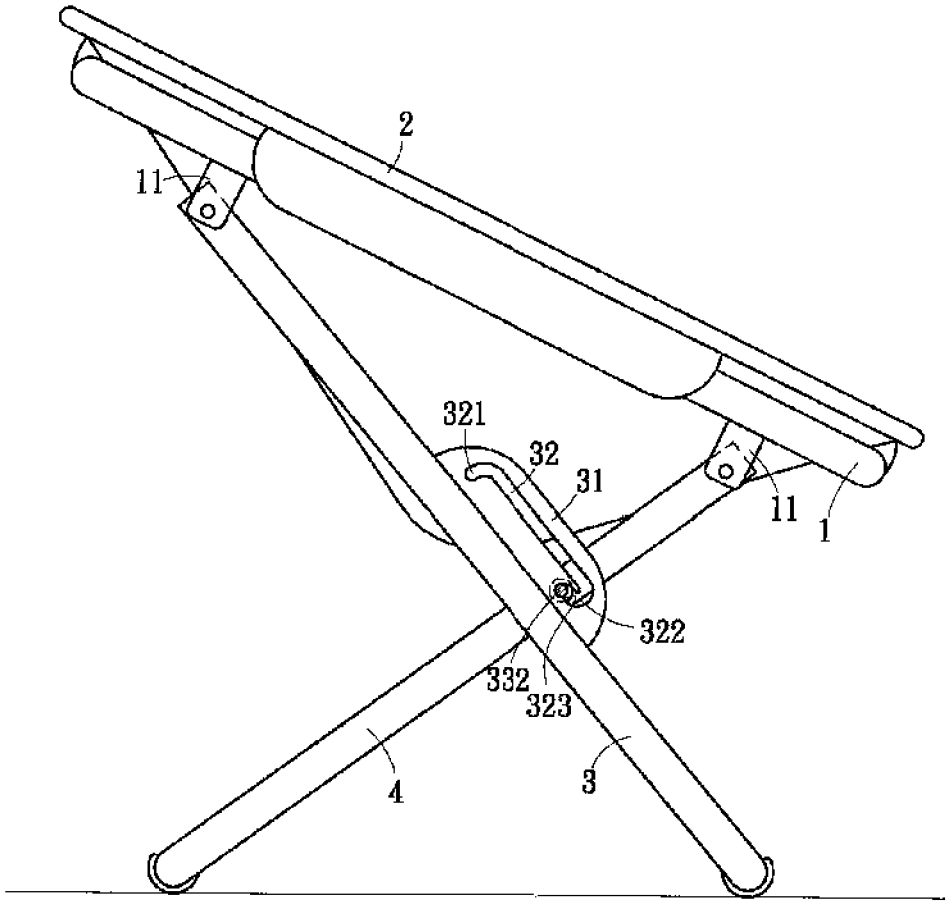
FIG. 3 is a side view of the present invention.

Referring to FIGS. 1, 2 and 3, the present invention of a foldable lounge chair includes a seat frame 1 having a seat fabric 2. The front and rear parts 11 of the seat frame 1 are hinged to a front leg 3 and a rear leg 4, with the middle parts of the front leg 3 and the rear leg 4 crossing each other at specified locations. At the crossing, a hinge plate 31 is fixed onto the front leg 3. A guide grove 32 is formed in the hinge plate 31. An upper and lower arrest unit 321, 322 are formed on an upper part and a lower part of the guide groove 32. The lower arrest unit 322 is a recess curving upwards. On one side of the lower arrest unit 322, a projected retaining part 323 is provided. A bolt 333 is provided to run through a washer 332, the guide groove 32, a sleeve 331, and then finally through the rear leg 4 whereby the bolt 333 is hinged and secured thereon. Up and down movement of the bolt 333 is permitted inside the guide groove 32.

Therefore, when the front leg 3 and the rear leg 4 of the lounge chair are unfolded, the bolt 333 glides down inside the guide groove 32 into the lower arrest 322. Since the lower arrest unit 322 is curved upwards, the two legs are secured in place after they are opened. Furthermore, the bolt 333 is arrested by the projected retaining part 323, so the bolt 333 is trapped inside the lower arrest unit 322. So, even when the chair is lifted and moved to another place, the two legs will not fold up. So the chair will not easily come apart when in use, and the chair can have enhanced stability when in use.

Figure 4:
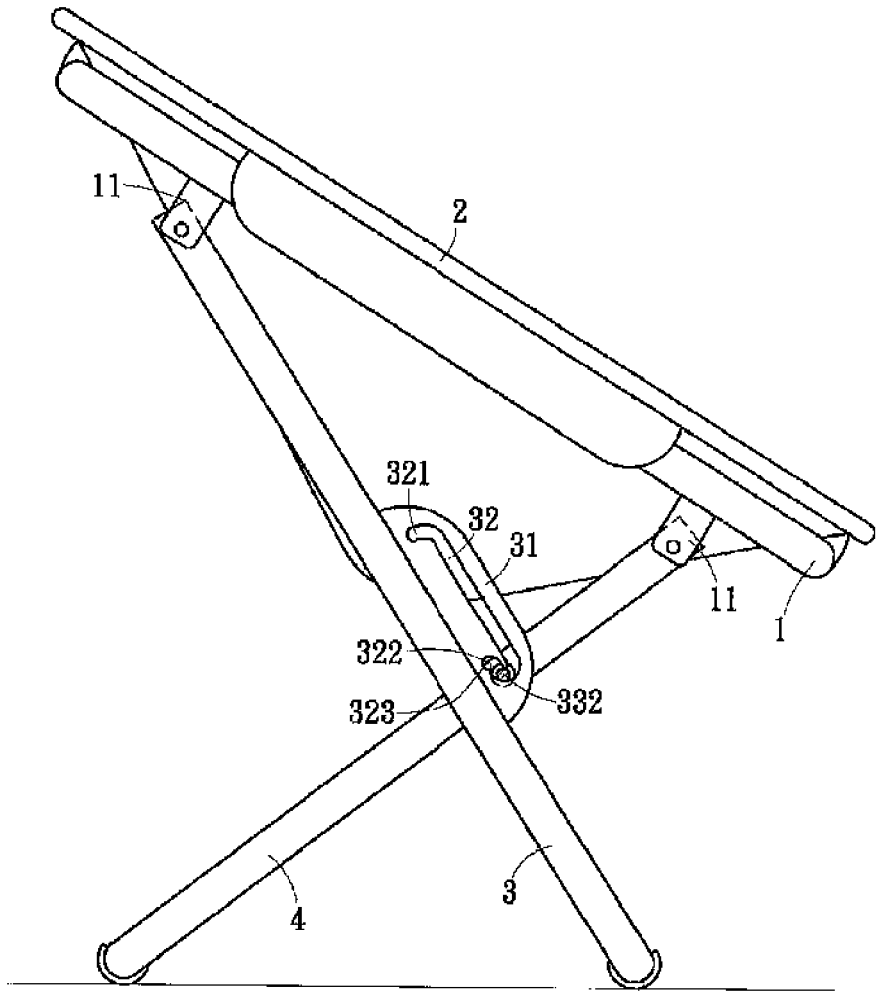
FIG. 4 is a side view showing the invention in folding process.
Figure 5:
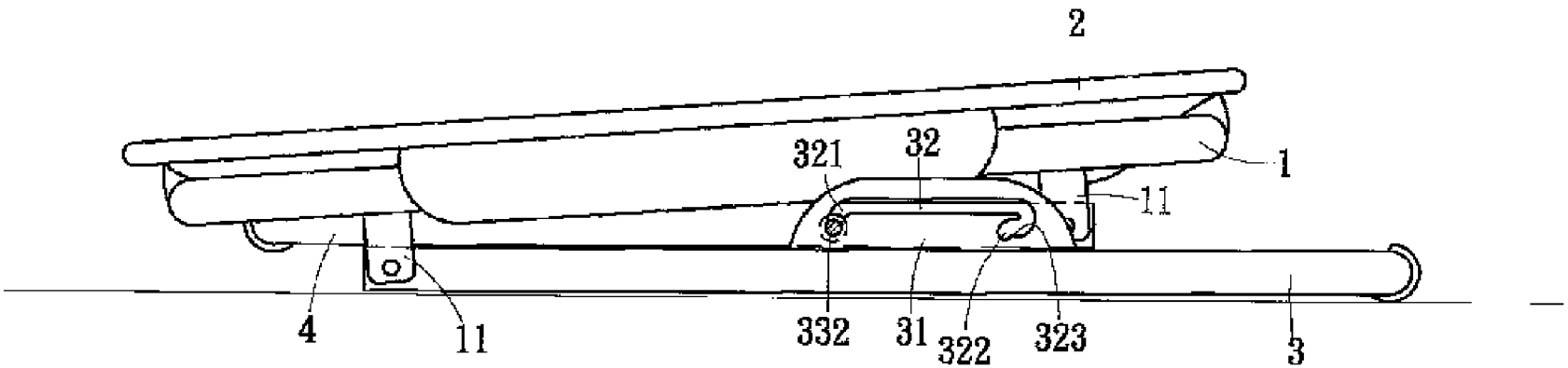
FIG. 5 is a side view showing the invention in folded status.

Conversely, as shown in FIGS. 4 and 5, the two legs can be folded by lightly patting on the rear leg 4. Thus, when the bolt 333 will escape the projected retaining part 323, and the bolt 333 will further glide up inside the guide groove 32 and into the upper arrest unit 321. Therefore, the two chair legs will fold up to minimize the size of the chair for easy carrying and storing purposes.

What is claimed is:

1. A folding lounge chair, comprising a seat frame; a front leg and a rear leg hinged to a front part and a rear part of the seat frame, the front leg and the rear leg crossing and joined to each other at a joint, the front leg having a hinge plate with a guide groove having two ends, at the two ends of the guide groove being upper and lower arrest units, the lower arrest unit being curved upwards; and a bolt running through the guide groove, with the bolt having one end fixed onto the rear leg.

2. The foldable lounge chair as in claim 1, wherein a projected retaining part is installed at an end of the lower arrest unit at one of the two ends of the guide groove of the hinge plate.

3. The foldable lounge chair as in claim 1, wherein the bolt runs through a washer, the guide groove of the hinge plate, and a sleeve, with the bolt being fixed onto the rear leg.

* * * * *